United States Patent [19]

Drews et al.

[11] 4,058,106

[45] Nov. 15, 1977

[54] METHOD AND APPARATUS FOR RPM LIMITATION IN INTERNAL COMBUSTION ENGINES

[75] Inventors: Ulrich Drews, Schwieberdingen; Bernd Kraus, Stuttgart; Erich Singer, Besigheim; Hans Schnürle, Walheim, all of Germany

[73] Assignee: Robert Bosch GmbH, Stuttgart, Germany

[21] Appl. No.: 679,379

[22] Filed: Apr. 22, 1976

[30] Foreign Application Priority Data

Apr. 22, 1975 Germany ..... 2517697

[51] Int. Cl.[2] ..... F02B 3/00; F02B 77/00

[52] U.S. Cl. ..... 123/198 DB; 123/118; 123/32 EA

[58] Field of Search .... 123/198 D, 198 DB, 198 DC, 123/118, 32 EA, 102

[56] References Cited

U.S. PATENT DOCUMENTS

| | | | |
|---|---|---|---|
| 3,572,302 | 3/1971 | Wollesen | 123/118 |
| 3,601,103 | 8/1971 | Swiden | 123/198 DB |
| 3,884,203 | 5/1975 | Cliffgard | 123/118 |
| 3,916,865 | 11/1975 | Kiencke | 123/198 DB |

*Primary Examiner*—Ronald B. Cox

*Attorney, Agent, or Firm*—Edwin E. Greigg

[57] ABSTRACT

The maximum speed of an internal combustion engine is limited by a device which compares the period of rpm-synchronous pulses with the time constant of a reference multivibrator. If the engine rpm is so high that a pulse terminates prior to expiration of the reference time period, a gate is activated and acts through further multivibrator circuits to interrupt the fuel delivery to the engine, e.g., the fuel injection control pulses are suppressed. If the maximum rpm is exceeded only intermittently, the device restores normal fuel injection control pulses after a predetermined number of pulses has been suppressed. If the maximum rpm is exceeded continuously, the device restores normal fuel control somewhat later than the time at which the engine speed drops to below maximum rpm.

16 Claims, 4 Drawing Figures

METHOD AND APPARATUS FOR RPM LIMITATION IN INTERNAL COMBUSTION ENGINES

BACKGROUND OF THE INVENTION

The invention relates to a method and an apparatus for limiting the top rpm in an internal combustion engine. It more especially relates to engines in which the fuel quantity required per cycle is provided in dependence on rpm and aspirated air quantity by a fuel injection system or a mixture preparing device such as a carburetor.

The majority of internal combustion engines is so constructed that when they are operated at full throttle in the lower gears, or if full throttle is maintained in downhill operation, the engine may reach rpm domains which exceed the design limits and engine damage such as breakage of valves, overheating and the like may result from this operation. Accordingly, the top rpm of the engine should be limited.

A known method for limiting the rpm of an internal combustion engine provides short-circuiting the ignition by means of a centrifugal switch which is usually part of the distributor mechanism.

This process is relatively coarse because of the unavoidable mechanical tolerances and also because there must be a mechanical movement prior to action so that, in general, this known device can interrupt ignition only in a given range of the engine rpm.

Furthermore, the interruption of ignition prevents the combustion of the mixture in the cylinders, but does not prevent the production of a flammable mixture which passes into the exhaust system and collects there. At the moment when ignition reoccurs, this flammable mixture in the exhaust system may combust with the obvious detrimental results. If the engine is equipped with an after-burner or catalyzer, the known method for limiting the rpm by interrupting the ignition is particularly detrimental because the uncombusted fuel-air mixture will heat the catalyzer and may lead to its destruction.

OBJECT AND SUMMARY OF THE INVENTION

It is a principal object of the invention to provide a method and apparatus for limiting the rpm of an internal combustion engine by influencing the quantity of fuel supplied to the engine, thereby avoiding dangerous overheating of exhaust system catalyzers and completely avoiding any influence on the ignition system.

It is a further object of the invention to provide a method and apparatus for limiting the rpm of an internal combustion engine which does not produce abrupt rpm changes of the engine when the limiting rpm is crossed.

Yet another object of the invention is to provide a method and an apparatus which limits the engine rpm without unduly increasing the catalyzer temperature.

These and other objects are achieved by the invention by providing that, each time the limiting rpm is exceeded, the fuel supply to the engine is completely stopped for a predetermined and adjustable time, preferably for the duration of 2 to 4 fuel injection control pulses. The invention further provides that, when the limiting rpm is continuously exceeded, all of the fuel injection control pulses are suppressed including a number of the pulses following subsequent lowering of the rpm below the limit.

An apparatus for carrying out the above-described method provides a first monostable multivibrator which is triggered by an rpm-synchronous pulse, and the duration of the unstable state of this multivibrator is a measure of the limiting rpm. The apparatus then further provides a subsequent AND gate whose other input receives the rpm-synchronous trigger pulse directly and whose output is fed to a second monostable multivibrator feeding a third monostable multivibrator which controls the passage of fuel injection pulses.

A particular advantage of the present invention is that it does not follow the simple procedure of completely shutting off the fuel supply at a given rpm and then reinitiating the fuel supply when the rpm drops below the limit. Such a simple control process would lead to a very abrupt and jerky operation of the engine in the range of the limiting rpm. Instead of this simple on-off process, the invention provides that, when the limiting rpm is reached only once, then the fuel supply is interrupted for a predeterminable time which is relatively short and, for the case of fuel injection, may be of a length of approximately 2 to 4, preferably 3, injection pulses. If at the expiration of this period, the fact that the rpm limit has been exceeded (which can be determined very precisely) no longer obtains, then the system does not react further. Since the system of the present invention does not return to the normal engine operation just at the time when the rpm has dropped below the limit, means that the system is not subject to effects of switching hysteresis.

The short-term interruption of the fuel supply results in a loss of engine torque and hence in a drop in the rpm so that, even when the engine is operated at full throttle, it remains near the rpm limit and the engine rpm oscillates about that limit at a frequency which depends on the number of injection pulses which are suppressed.

The present invention further provides that only if the limiting rpm is continuously exceeded, which might be the case when the vehicle is operated in low gears or in downhill travel, is the fuel supply completely inhibited and, further, that when the rpm drops below the permissible limit, fuel injection is not resumed until after the expiration of an adjustable delay, for example 3 fuel injection pulses, if applicable.

The subsequent detailed description is made in relation to a method and apparatus to be associated with a fuel injection system, but it should be clear that the circuits and the method may also be adapted to any other mixture-preparing system with only small changes and that its operation will then be slightly different.

The invention will be better understood as well as further objects and advantages thereof become more apparent from the ensuing detailed description of a preferred embodiment taken in conjunction with the drawing.

DESCRIPTION OF THE PREFERRED EMBODIMENT

For purposes of explanation, the apparatus according to the invention is discussed in association with a fuel injection system which already contains a circuit for generating rpm-dependent fuel control pulses in a duty cycle of approximately 0.5 (duty cycle = pulse duration/period). The trigger pulse train is shown as pulse train 1 in FIGS. 3*a* and 3*b*. Such a pulse train may also be derived from the ignition pulses of the engine, as will be discussed in more detail below.

Figure 1:
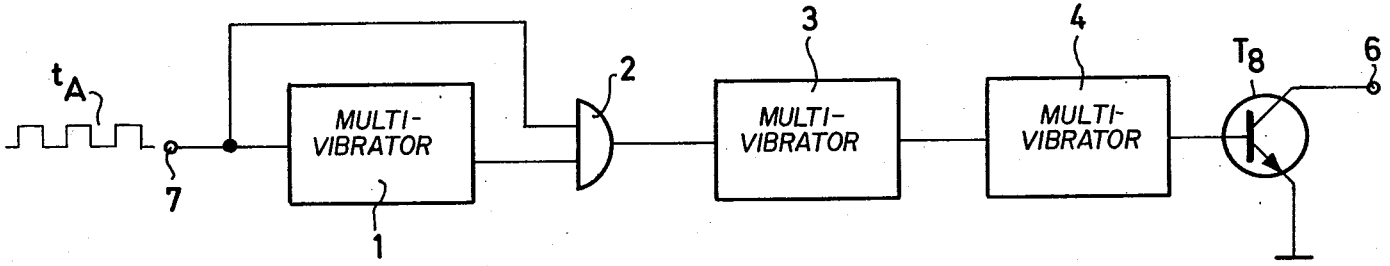
FIG. 1 is a block diagram of an apparatus according to the invention.

Turning now to FIG. 1, there will be seen a monostable multivibrator 1 which receives the pulses from the above-mentioned control pulse generator and which is adjusted to a precise time constant $t_{ref}$ which defines its unstable state and which is related to the maximum permissible limiting rpm. The system is so connected that when the monostable multivibrator 1 is still in its unstable condition when the limiting rpm is reached and when the triggering pulse has returned to its other state because of the shortening pulse duration, a subsequent AND gate 2 recognizes coincidence and triggers a subsequent second monostable multivibrator 3, hereinafter referred to as a storage flip-flop. The storage flip-flop 3 then latches in its unstable stage for a predetermined time after which it triggers a subsequent third monostable multivibrator 4 which in turn, generates an output signal that causes an interruption of the fuel injection control pulses, preferably by controlling the base of a subsequent transistor T8 which, when conducting, grounds any fuel control pulses connected at the output terminal 6 of the circuit. The pulse train fed to the input 7 of the circuit shown in FIG. 1 is rpm-dependent. As a consequence, the pulse duration changes; in a four-cycle, four-cylinder internal combustion engine, the ignition system produces two ignition pulses per crankshaft revolution, i.e., a total of 4 ignition pulses for every two crankshaft revolutions. As a consequence, each cylinder of the four-cylinder engine performs one power stroke during each two crankshaft revolutions. If these ignition pulses are used for triggering a bistable multivibrator, then, in the special case of a four-cycle, four-cylinder engine, one obtains the trigger sequences 1 in FIGS. 3*a* and 3*b*. In internal combustion engines with a different number of cylinders, the curves 1 would be suitably changed.

Figure 2:
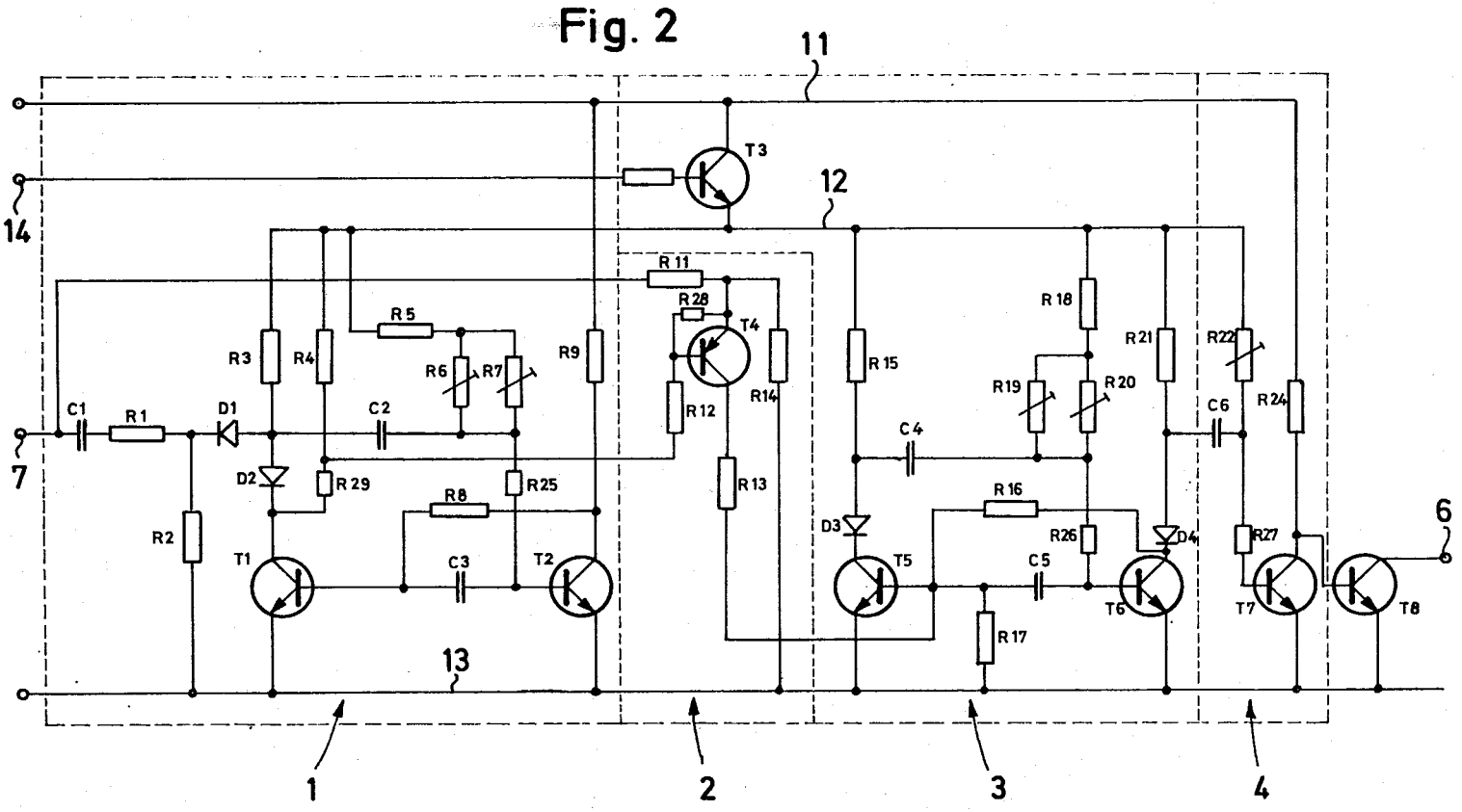
FIG. 2 is a detailed circuit diagram of the block diagram of FIG. 1.

The detailed circuit diagram of the apparatus of the invention is depicted in FIG. 2. The triggering pulse is supplied to an input contact 7. The output contact 6 acts directly on the fuel control pulses and shortens them to ground during a period of time defined by the circuit in FIG. 2.

The circuit shown in FIG. 2 includes a constant current source which is required because of the necessary precision and this source includes a transistor T3 whose collector is connected to the normal positive supply line 11 of the main vehicle current supply which is usually subject to voltage fluctuations. The emitter of transistor T3 is connected to a positive supply line 12 which will be the actual positive supply for the circuit of FIG. 2. The negative supply line is labeled 13. The foregoing discussion is given for elucidation and it should be understood that, when other semiconductor types are used, the respective polarities of the various voltages may be reversed. The base of the transistor T3 is supplied via a separate input contact 14 with a stabilized voltage, obtained preferably with the aid of a Zener diode.

An important requirement of the control circuit is to set the limiting rpm very precisely and to maintain that value for long periods of time, firstly, to make full use of the entire rpm domain of the engine and, secondly, especially for vehicles with automatic transmission, to insure that the limiting rpm is always greater than that speed at which the automatic transmission would normally initiate an upshift to the next higher gear. These shifting speeds are fixed in the automatic transmission and thus it is very important that the limiting rpm is never lower than any of these shifting speeds even during prolonged operation, because, otherwise, the automatic transmission would be unable to reach the next higher gear due to the throttling action of the rpm-limiting system.

The monostable multivibrator 1 includes two transistors T1 and T2 which are connected in the customary manner so that the transistor T2 normaly conducts while the transistor T1 is normally blocked. For this purpose, the base of the transistor T2 is connected in series with a resistor R25, two parallel resistors R6 and R7 and a further resistor R25 to the positive supply line. The base of the transistor T1 is connected through a resistor R8 with the collector of the transistor T2, and, therefore, normally blocks T1. The emitters of both transistors T1 and T2 are connected directly to the negative supply line, while the collector of the transistor T2 is connected through a resistor R9 to the positive supply bus 11. The collector of the transistor T1 is connected in series with a diode D2 and a resistor R3 to the positive line 12. Parallel to this series connection is another series connection of a further resistor R29 and a resistor R4. The junction of resistors R29 and R4 is connected through a resistor R12 to the base of a further transistor T4 which forms the AND gate 3 and will be discussed below.

The monostable multivibrator 1 is flipped into its unstable state by the negative-going edge of the trigger pulse train which is differentiated by a capacitor C1 in series with a resistor R1 and a grounded resistor R2. The negative pulse generated by the differentiator passes through the diode D1 and a capacitor C2 and the resistor R25 to the base of the transistor T2 and blocks it. Until the charge exchange of the capacitor C2 is completed via adjustable resistors R6 and R7 in series with the resistor R5, the monostable multivibrator 1 remains in its unstable state and thus defines a precise reference time $t_{ref}$. In the exemplary embodiment shown, the monostable multivibrator is adjusted so that its unstable period corresponds to onehalf crankshaft revolution at limiting rpm. Translated into numerical values, $t_{ref} = 5.45$ milliseconds when the limiting rpm is 5500 rpm. During the unstable state, the monostable multivibrator 1 supplies the substantially negative potential at the collector of transistor T1 through resistors R29 and R12 to the base of the transistor T4. If the monostable multivibrator 1 is still in its unstable state at a time when the voltage at the input contact 7, determined by the trigger pulse train, jumps back to a positive potential, then the transistor T4 will conduct and a very short positive pulse will reach the base of a subsequent transistor T5 which is a part of the above-mentioned monostable storage flip-flop 3. The transistor T4, which forms the AND gate 2, is connected by its emitter through a resistor R11 to the input contact 7, while its collector is connected through a resistor R13 to the base of the transistor T5. A resistor R28 is connected between the base and the emitter of transistor T5, and the emitter itself is connected through a resistor R14 to the negative supply line. The diode D2 connected to the collector of the transistor T1 serves to compensate for the base-emitter voltage of the transistor T2 which would otherwise affect the time constant of the monostable multivibrator 1. Furthermore, the uncoupling provides a very steep edge for the pulse which is fed to the base of the transistor T4 through the resistors R29 and R12 because the collector of the transistor T1 rapidly returns to the positive potential when the monostable multivibrator returns to its stable state. In this manner, the steepness of the switching edge is not affected by the charging process on the capacitor C2.

The resistor R29 serves to raise the base voltage of the transistor T4 when the flip-flop 1 is in its unstable state and T1 conducts. If the resistor R29 were not present, and if the saturation voltage of the transistor T1 were small, the base of the transistor T4 would be pulled practically to a negative supply potential which might produce difficulties in the operation of the transistor T4, especially if it has high current gain, because the emitter voltage of the transistor T4 is higher than the base voltage only by the base-emitter voltage drop so that the collector would carry no current or at least not a well-defined current. By raising the base potential of the transistor T4 via the resistor 29, this problem disappears and this is also aided by the connection of the resistor R28 between the base and the emitter of the transistor T4. The voltage across the resistor R28 is the base-emitter voltage of that transistor whose current must flow through the resistor R12 and produces there a corresponding voltage drop which raises the base voltage of the transistor T4. However, the series connection of resistors R28 and R12 has still another function which comes into play in the normal case when the flip-flop 1 returns to its stable state and thus the collector potential of the transistor T1 returns virtually to that of the positive supply line 12, but the emitter of the transistor T4 is still connected to ground through the contact 7. Such a condition could produce a high voltage in the reverse direction of the base-emitter portion of the transistor T4, which could damage it. The values of the voltage divider resistors R28 and R12 are so chosen that any voltages occurring are kept within permissible limits.

The circuit is made less sensitive to extraneous influences by connecting the bases of transistors T1 and T2 through a capacitor C3 and by connecting, in a similar manner, the bases of transistors T5 and T6 via a capacitor C5. When a negative pulse arrives at the base of the transistor T2, tending to flip the multivibrator into its unstable state, this pulse also appears momentarily at the base of the transistor T1 so that, for an instant, both transistors are blocked. The length of the blockage is determined by the time constant of the capacitor C3 and the value of the resistor R8. In other words, any disturbing extraneous pulses whose duration is shorter than this time will not flip the multivibrator.

Extraneous and spurious influences are further prevented by connecting the resistor R25 in the base circuit of the transistor T2 and, in a similar manner by connecting the resistor R26 in the base circuit of transistor T6, and the resistor R27 in the base circuit of the transistor T7. The capacitor C2, through which the negative trigger pulse reaches the base of the transistor T2 to initiate the flip-over of the multivibrator 1, is connected to the junction of the resistor R3 and the diodes D1 and D2. Thus, even when stabilized voltage is used, any remaining voltage fluctuations of the plus line 12 are sensed at this junction point so that if the resistor R25 were not present, they would immediately affect the base of the transistor T2 and, due to the overall amplification of the multivibrator, could cause a shift into the metastable state.

The presence of the resistor R25 and resistors R5, 6 and 7 prevents the occurrence of such a disturbance. This is essentially due to the fact that the junction of the resistors R6, R7, capacitor C2 and resistor R25 is raised by the voltage drop across the resistor R25 due to the current flowing through the resistors R5, R6, R7, and R25.

Following the AND gate 2 is a monostable storage flip-flop 3 which is constructed very similar to the flip-flop 1 and will be discussed in less detail. The storage flip-flop 3 is controlled at the base of the transistor T5 by the positive potential from the transistor T4, rendering the transistor T5 conducting and placing the storage flip-flop 3 in its metastable state. In this manner, there is no influence on the time constant of the flip-flop by the usually present trigger capacitor. Similar to the diode 4, the diode 3 compensates for the base-emitter voltage of the transistor T6 or the transistor T7, while the time constant of the storage flip-flop 3 is determined by the capacitor C4 which discharges to the positive line 12 through the parallel adjustable resistors R19 and R20 in series with a resistor R18. Following the storage flip-flop 3 is a further monostable multivibrator 4, designed as a so-called economy flip-flop, consisting of a single transistor T7 whose emitter is grounded and whose collector is connected through a resistor R24 to the positive supply line 11, while its base is connected through a resistor R22 and the resistor R27 to the positive supply line 12. This economy flip-flop is controlled through a capacitor C6 connected to the junction of the two resistors R22 and R27. The other electrode of the capacitor C6 is connected to the collector of transistor T6 at the junction of a resistor R21 and a diode D4. Under normal conditions, the transistor T5 of the storage flip-flop 3 blocks while the transistor T6 conducts. When the limiting rpm of the engine is exceeded, the storage flip-flop 3 is flipped into its unstable state, the transistor T6 blocks and delivers a negative pulse through the capacitor C6 to the base of the subsequent transistor T7, which therefore blocks. An output transistor T8, controlled by the transistor T7, thus becomes conducting and may, for example, short out and suppress the fuel control pulses delivered to a fuel injection system.

Figure 3A:
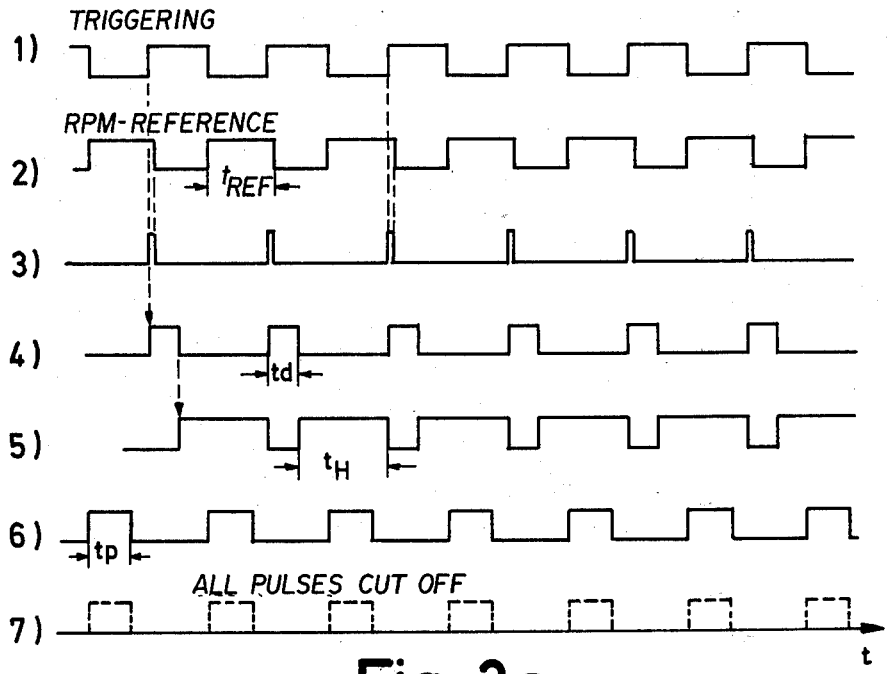
FIGS. 3*a* and 3*b* are timing diagrams of the pulses occurring in the apparatus according to the invention.
Figure 3B:
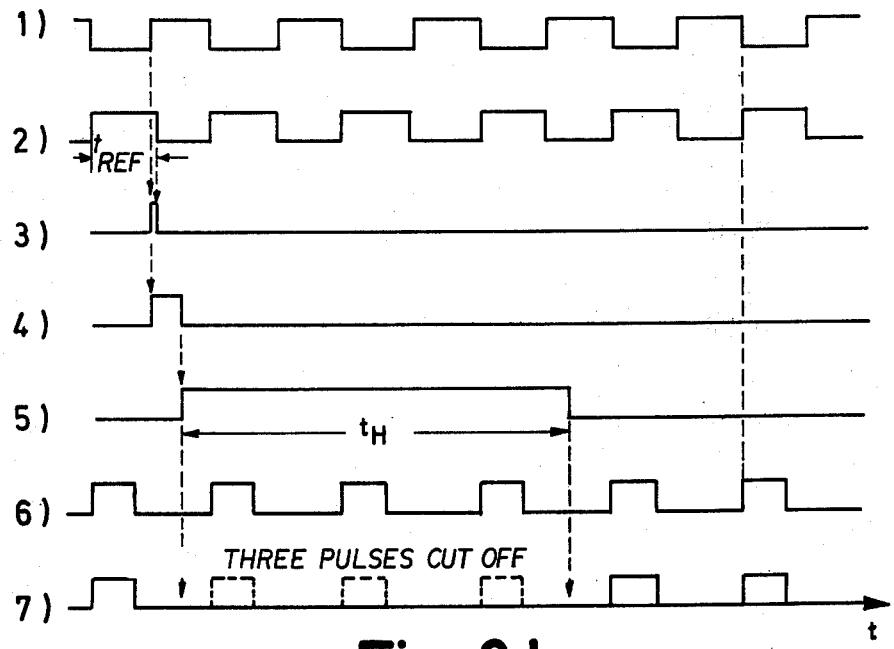

FIG. 3*b* shows the sequence of events. The pulse train 1 in FIG. 3*b* is the above-mentioned trigger pulse sequence, the pulse train 2 is the train of pulses occurring at the collector of the transistor T2 due to the triggering of the monostable multivibrator 1, the pulse duration $t_{ref}$ being predetermined. As already explained above, when there is an overlap, there is produced at least one output pulse at the collector of transistor T4 (as shown in pulse train 3) and triggers the subsequent monostable storage flip-flop whose time constant is so chosen that it lies at all times within the positive pulse of the trigger pulse train 1. The negative-going rear edge of the pulse from the storage flip-flop 3 triggers the monostable multivibrator 4 so that there occurs an output signal of the duration $t_H$ (see trace 5) at the collector of the transistor T7. The duration of the output pulse $t_H$ is so chosen that the next three following injection pulses, as represented by the trace 6, are suppressed. In the special exemplary embodiment, the pulses in the pulse train 6 may be the output pulses from a so-called control multivibrator circuit which is triggered by the negative-going edge of the trigger pulse train 1 and whose duration is determined as a function of the rpm and the aspirated air quantity of the internal combustion engine. From the timing diagram of FIG. 3*b* it may be seen that, in the exemplary embodiment shown, the next three pulses in the pulse train 6, which are substitutes for the fuel injection control pulses, are suppressed. Subsequently, this system returns to its original method of operation unless the limiting rpm continues to be exceeded, and this case will be treated in detail below. The method of operation of the monostable multivibrator 3 and the monostable multivibrator 4, which is an economy flip-flop, is such that when the limiting rpm is exceeded once, the transistor T4 conducts for a period of time which will be seen to be very short but which is sufficient to set the monostable storage flip-flop which acts as a genuine storage. Therefore, the transistor T6 blocks and the capacitor C6 is fully charged during this time via the resistor R21, so that, after the relatively rapidly occurring flip-back, the capacitor C6 has a charge which leads to the suppression of the next three injection pulses.

Actually, the information concerning the fact that the rpm limit has been exceeded is available at the output of the AND gate 2 or, more precisely, at the collector of the transistor T4. The subsequent elements 3 and 4 are required to obtain a smooth onset and decay of the control process when the limiting rpm is reached, namely, by suppressing only a predetermined number of pulses and thereby preventing any drastic rpm or torque fluctuations which would produced jerky vehicle operation.

When the rpm limit is exceeded only once, the above-described control process may be favored by the fact that the ignition timing may itself be subject to fluctuations so that, when the limiting rpm is reached, a trigger pulse from the monostable storage flip-flop 3 may already be produced and thereby cause a particularly smooth onset of the rpm limitation because the three subsequent control pulses, in the present exemplary embodiment, are suppressed and the torque decreases so that the limiting rpm is not even reached. This state of affairs is displayed in the timing diagrams of FIG. 3*b*. A somewhat different operation of the circuit of FIG. 2 results if the limiting rpm is continuously exceeded because, in that case, at each positive-going edge of the pulses in the pulse train 1, the AND gate 2 delivers a short action pulse shown in the pulse train 3 of FIG. 3*a*. This means that the storage flip-flop 3 is continuously set and returned during the pulse duration of the positive trigger pulse which generated this action pulse so that the pulse $t_H$ shown in the trace 5 is produced, as already described above, but where it is interrupted during the renewed setting of the storage flip-flop 3 because this leads to a renewed blockage of the transistor T6 and hence to a positive voltage jump at the capacitor C6 which charges this capacitor in the desired manner as in the case of a single release, but at the same time the transistor T7 still conducts which blocks the transistor T8. The transistor T8 blocks as long as the storage flip-flop remains in its unstable state and at its collector occurs the pulse train 5 of FIG. 3*a*, provided that this collector is connected to the positive potential through a resistor. However, the time constant of the storage flip-flop 3 is within the elapsed time between the injection control pulses, as may be seen from the timing diagrams of FIGS. 3*a* and 3*b*. In good time, prior to the arrival of the next control pulse, the storage flip-flop 3 returns (this adjustment can also be made by adjusting the resistors R19 and R20 because the appropriate limiting rpm and hence the separation of control pulses is known), so that when the limiting rpm is continuously exceeded, all of the fuel injection control pulses are suppressed, as shown in the pulse train 7, i.e., the fuel injection valves receive no control pulses at all. This fact is indicated by the dashed pulses in the trace 7 in FIGS. 3*a* and 3*b*.

Thus, the economy flip-flop consisting of a transistor T7 is able to follow directly the pulses which it receives through the capacitor C6 but, if these pulses are not present, and if the transistor T6 conducts, i.e., the storage flip-flop is in its normal state, then the charge exchange of the capacitor C6 takes place through the adjustable resistor 22 during an adjustable period of time until the negative potential at the base of the transistor T7 has decayed and the injection control pulses are no longer suppressed. In the present illustrated exemplary embodiment, this duration is preferably equal to three control pulses as shown in the trace 7 of FIG. 3*b*. For the remainder, the entire triggering process for the circuit takes place within the time of the positive pulse of the trigger pulse sequence, as may be clearly seen in FIG. 3*b*, since the positive-going front edge of the first pulse in coincidence with the unstable state of the first monostable flip-flop 1 generates the trigger pulse for the storage flip-flop which, in turn, flips back, as shown in the trace 4, and triggers the monostable flip-flop 4 prior to the arrival of the negative-going edge of the trigger pulse which also generates the fuel injection control pulse.

The foregoing is a description of a preferred exemplary embodiment of the invention and many other variations and embodiments of the method and the apparatus of the invention are possible within the spirit and scope thereof, the scope being defined by the appended claims.

What is claimed is:

1. A method for limiting the rpm in an internal combustion engine, said engine including fuel preparation means, comprising the steps of:

interrupting fuel supply for a predetermined period of time after the engine has reached a predeterminable limiting rpm; and suppressing all fuel supply when the limiting rpm of the engine is exceeded and continuing to suppress all fuel supply for a predetermined time after the engine rpm has again dropped below the limiting rpm.

2. An apparatus for rpm-limitation in an internal combustion engine, said engine including fuel preparation and metering means, comprising:

a first monostable multivibrator, triggered by rpm-synchronous pulses supplied by the engine, the time constant of said first multivibrator defining a reference time period;

an AND gate whose one input is connected to receive the output of said first multivibrator and whose second input is connected to receive directly said rpm-synchronous signal;

a second monostable storage multivibrator, triggered by said AND gate; and a third monostable multivibrator, controlled by said second monostable multivibrator, and connected to said fuel preparation means for suppressing fuel control signals therefrom.

3. An apparatus as defined by claim 2, wherein said first monostable multivibrator includes two transistors T1 and T2 whose emitters are connected directly to a first voltage supply of the circuit, the collector of the normally blocked transistor T1 is connected in series with a diode D2 and a resistor R3 to the opposite supply voltage of the circuit, and the collector of the transistor T1 is connected in series with a resistor R29 and a further resistor R12 to the base of a transistor T4 which constitutes said AND gate and wherein the junction of the two resistors R29, R12 is connected through a further resistor R4 to said opposite supply voltage of the circuit.

4. An apparatus as defined by claim 3, wherein the junction of said diode D2 and said resistor R3 is connected to one electrode of a capacitor C2 whose charging time defines said reference time and whose other electrode is connected in series with a resistor R25 to the base of the other transistor T2 and that said junction between said diode D2 and said resistor R3 is connected in series with a resistor R1 and a capacitor C1 to a contact for receiving said rpm-synchronous pulses while the junction between said resistor R1 and said diode D1 is connected in series with a resistor R2 to ground.

5. An apparatus as defined in claim 4, wherein the emitter of the transistor T4 which forms said AND gate is connected through a resistor R11 to said contact 7 which receives said rpm-synchronous pulses; whereby the collector of said transistor T4 carries a trigger signal whenever the next positive-going edge of said rpm-synchronous pulses occurs prior to the expiration of the time constant of said monostable multivibrator in its unstable state.

6. An apparatus as defined by claim 5, wherein said second monostable storage multivibrator includes two transistors T5, T6 whose emitters are connected directly to one supply voltage of said circuit, while their collectors are connected through diodes D3, D4, respectively, and resistors R15, R21, respectively, to the other supply voltage of said circuit.

7. An apparatus as defined by claim 6, wherein the base of the normally blocking transistor T5 is connected through a resistor R13 to the collector of the transistor T4 which forms said AND gate and thereby is also connected to the output of said AND gate.

8. An apparatus as defined by claim 7, wherein the collector of the normally conducting transistor T6 of said storage multivibrator is connected through a capacitor C6 in series with a resistor R27 to the base of a transistor T7 which constitutes said third monostable multivibrator and wherein the emitter of said transistor T7 is connected to one supply voltage of said circuit while its collector is connected through a resistor R24 with a conductor whose potential substantially corresponds to the voltage on the other of said supply voltages of said circuit.

9. An apparatus as defined by claim 8, wherein the collector of the transistor T7 which constitutes a third monostable multivibrator is connected to the base of a further transistor T8 whose emitter is connected directly to the more negative supply voltage of the circuit and whose collector receives the fuel control injection signals from said fuel preparation means.

10. An apparatus as defined by claim 9, wherein the base electrodes of transistors T1, T2 are joined through a capacitor C3 and wherein the base electrodes of said transistors T5, T6 are joined through a capacitor C5.

11. An apparatus as defined by claim 10, wherein the electrode of said capacitor C2 which defines the time constant of said monostable multivibrator 1 that is connected to the base of the normally conducting transistor T2 is also connected through further timing resistors R5, R6, and R7 to the opposite supply voltage 12 of said circuit and wherein the electrode of said capacitor C4 connected to the base of the transistor T6 is also connected through timing resistors R18, R19, R20 to the opposite supply voltage of said circuit.

12. An apparatus as defined by claim 11, wherein said timing resistors which connect one electrode of said capacitor C2 with said opposite supply voltage 12 are formed from two parallel adjustable resistors R6 and R7 and a series resistor R5 while the connection between the electrode of said capacitor C4 to said opposite supply voltage is formed by the parallel connection of two adjustable resistors R19 and R20 in series with a further resistor R18.

13. An apparatus as defined by claim 12 further including a transistor T3 whose base receives stabilized voltage and whose emitter is connected to said opposite supply voltage 12 while its collector is connected to one of the primary voltage supply sources of said circuit, for stabilizing the voltage supplied to said first, second and third multivibrators.

14. An apparatus as defined by claim 13, wherein the base and the emitter of said transistor T4 which constitutes said AND gate 2 are connected via a resistor R28.

15. An apparatus as defined by claim 10, wherein the base of transistor T2 is connected through a resistor R25 to the junction of timing capacitor C2 and resistors R6 and R7, and wherein the base electrode of transistor T6 is connected through a resistor R26 to the junction of the timing capacitor C4 and resistors R19 and R20, and wherein the base electrode of transistor T7 is connected through a resistor R27 to the junction of the timing capacitor C6 and said resistor R22.

16. A method for limiting the rpm in an internal combustion engine, said engine including fuel injection means, comprising the steps of:

interrupting fuel supply for a duration of preferably two to four injection pulses after the engine has reached a predeterminable limiting rpm; and suppressing all fuel injection pulses when the limiting rpm of the engine is exceeded and continuing to suppress two to four pulses after the engine rpm has again dropped below the limiting rpm.

* * * * *